US009068130B2

(12) United States Patent
McFarlane

(10) Patent No.: US 9,068,130 B2
(45) **Date of Patent: *Jun. 30, 2015**

(54) PROCESSING OF DEHYDRATED AND SALTY HYDROCARBON FEEDS

(75) Inventor: Richard A. McFarlane, Edmonton (CA)

(73) Assignee: Suncor Energy Inc., Calgary (CA)

( * ) Notice: Subject to any disclaimer, the term of this patent is extended or adjusted under 35 U.S.C. 154(b) by 244 days.

This patent is subject to a terminal disclaimer.

(21) Appl. No.: 13/262,947

(22) PCT Filed: Apr. 16, 2010

(86) PCT No.: PCT/CA2010/000607

§ 371 (c)(1),
(2), (4) Date: Dec. 16, 2011

(87) PCT Pub. No.: WO2010/121375

PCT Pub. Date: Oct. 28, 2010

(65) Prior Publication Data

US 2012/0074044 A1 Mar. 29, 2012

(30) Foreign Application Priority Data

Apr. 22, 2009 (CA) ..... 2663661

(51) Int. Cl.
*C10G 29/22* (2006.01)
*C10G 1/04* (2006.01)

(52) U.S. Cl.
CPC ..... *C10G 29/22* (2013.01); *C10G 2300/4081* (2013.01); *C10G 2300/805* (2013.01)

(58) Field of Classification Search
CPC .. C10G 21/16; C10G 21/28; C10G 2300/202; C10G 2300/203; C10G 2300/80; C10G 1/04
USPC ..... 208/187, 188, 262.1, 290, 291, 370
See application file for complete search history.

(56) References Cited

U.S. PATENT DOCUMENTS 1,472,384 A 10/1923 Brown
2,269,134 A 1/1942 Tarnoski (Continued)

FOREIGN PATENT DOCUMENTS

WO WO2009/070255 A2 4/2009
WO 2012/015666 A2 2/2012

OTHER PUBLICATIONS

Parkash, S, Refining Processes Handbook, 2003, Gulf Publishing, p. 1-28.*

(Continued)

*Primary Examiner* — Walter D Griffin
*Assistant Examiner* — Derek Mueller
(74) *Attorney, Agent, or Firm* — McCarthy Tétrault LLP

(57) ABSTRACT

It provides for processing a dehydrated and salty hydrocarbon feed having a solid salt dispersed in a hydrocarbon material by contacting the feed with an active agent under a first operating condition under which the active agent has an initial active agent solubility in the hydrocarbon material, and modulating operating conditions to provide a second operating condition under which the active agent has a secondary active agent solubility in the hydrocarbon material that is less than the initial active agent solubility so as to form a separable active agent phase, wherein the salt solubility in the active agent is substantially greater than the salt solubility in the hydrocarbon material under both the first and second operating conditions such that the salt dissolves in the active agent, allowing the separable active agent phase to separate from the hydrocarbon material depleted in the salt.

58 Claims, 5 Drawing Sheets

(56) References Cited

U.S. PATENT DOCUMENTS

| | | | |
|---|---|---|---|
| 2,391,729 | A | 12/1945 | McCorquodale |
| 2,610,209 | A | 9/1952 | Honeycutt |
| 2,769,768 | A | 11/1956 | Fierce |
| 2,808,431 | A | 10/1957 | Fierce |
| 3,644,214 | A | 2/1972 | Akell |
| 4,001,109 | A | 1/1977 | Li |
| 4,098,692 | A | 7/1978 | Baker |
| 4,216,079 | A | 8/1980 | Newcombe |
| 4,216,114 | A | 8/1980 | Baker |
| 4,406,774 | A | 9/1983 | Cummings |
| 4,551,239 | A | 11/1985 | Merchant |
| 4,634,519 | A | 1/1987 | Danzik |
| 4,684,457 | A | 8/1987 | McKechnie |
| 4,737,265 | A | 4/1988 | Merchant |
| 4,738,795 | A | 4/1988 | Farnand |
| 4,895,641 | A | 1/1990 | Briceno |
| 5,039,450 | A | 8/1991 | Kupfer |
| 5,746,908 | A | 5/1998 | Mitchell |
| 5,855,768 | A | 1/1999 | Stanciulescu |
| 6,096,196 | A | 8/2000 | Varadaraj |
| 6,190,541 | B1 | 2/2001 | Siskin |
| 6,464,859 | B1 | 10/2002 | Duncum |
| 6,627,069 | B2 | 9/2003 | Greaney |
| 6,989,103 | B2 | 1/2006 | Mohsen |
| 2007/0175799 | A1 | 8/2007 | Tomlinson |
| 2009/0134068 | A1 | 5/2009 | Falkiner |

OTHER PUBLICATIONS

Akerlof, G, Dielectric Constants of Some Orgainic Solvent-Water Mixtures at Various Temperatures, 1932, JACS, vol. 54, No. 11, p. 4124-4139.*

Hobson, G., Modern Petroleum Technology, 1973, Halsted Press, p. 183-184.*

Lemley, et al., "Liquid Ammonia Solutions X A Raman Study of Interactions in the Liquid State", *The Journal of Physical Chemistry*, vol. 77, No. 18, 1973.

Bratsch, et al, "On the Existence of Na- in Liquid Ammonia, The Journal of Physical Chemistry", vol. 88, No. 6, 1984.

Nour, et al., "Chemical Demusification of Water-in-Crude Oil Emulsions", Journal of Applied Sciences, 7(2): 196-201, 2001.

International Search Report and Written Opinion issued on Jul. 28, 2010 for International Application No. PCT/CA2010/000607.

Baker-Hughes, Planning Ahead for Effective Canadian Crude Processing, 2010, 7 pages.

Ovchinnikov et al., "Oil sands-derived feed processing," digitalrefining.com article 1000850, Jul. 2013.

* cited by examiner

PROCESSING OF DEHYDRATED AND SALTY HYDROCARBON FEEDS

CROSS REFERENCE TO RELATED APPLICATIONS

This application is the U.S. National Phase of International Application No. PCT/CA2010/000607, filed Apr. 16, 2010, designating the U.S. and published as WO 2010/121375 on Oct. 28, 2010 which claims the benefit of Canadian Patent Application No. 2,663,661 filed Apr. 22, 2009.

FIELD OF THE INVENTION

The invention relates generally to processing of hydrocarbon feeds derived from in situ and ex situ tar sand and heavy oil operations, off shore oil production operations, conventional oil, secondary and tertiary recovery, and natural gas operations. More particularly, the invention relates to processing dehydrated and salty hydrocarbon feeds to effect desalting, and thereby obtain a hydrocarbon material having a salt content reduced to a level suitable for downstream processing operations.

BACKGROUND OF THE INVENTION

Hydrocarbon feeds derived from various oil and gas processing operations such as, for example, various bitumen-derived hydrocarbon fractions often contain impurities harmful to the efficient operation of downstream processes, and affect the quality of the final hydrocarbon product. Such impurities include salts commonly found in hydrocarbon feeds such as, for example, sodium chloride, magnesium chloride and calcium chloride. These salts are unstable at elevated temperatures, and if allowed to remain in the hydrocarbon feeds throughout the various stages of processing, they will dissociate and form corrosive compounds (e.g., hydrochloric acid), which contribute to corrosion of equipment such as piping and instrumentation for instance. In addition to sodium, magnesium and calcium salts, other metal salts including potassium, nickel, vanadium, copper, iron and zinc may also be found in various hydrocarbon feeds and contribute to fouling of equipment, coking, catalyst poisoning and end product degradation.

Dehydrated and salty hydrocarbon feeds may arise when hydrocarbon feeds, initially containing water with dissolved salts, are substantially dehydrated by removal of bulk water and removal of the water as water vapour for example. Hydrocarbon feeds containing water are also called emulsions or more precisely water-in-hydrocarbon emulsions. The mass percent of water in such hydrocarbon emulsions can range from about 0.01 wt. % to about 50 wt. %. When water is substantially removed from such emulsions, as vapour for example, dissolved salts which cannot be vaporized with the water, and thereby removed, will remain as very fine solids dispersed within the hydrocarbon material resulting in the hydrocarbon material having a dispersed salt content.

A variety of approaches have been proposed for desalting dehydrated and salty hydrocarbon feeds. For example, one conventional approach involves mixing water with the dehydrated and salty hydrocarbon feeds so that water may solubilize the salts dispersed in the hydrocarbon material of the feed and thereby desalt the hydrocarbon feed. Addition of water, however, results in emulsion formation, which is often challenging to resolve and requires various chemical treatments or other methods such as, for example, the use of electrical field to effect emulsion breaking and phase separation. Furthermore, the salts attempted to be removed with water may continue to remain with the hydrocarbon feed at relatively high levels due to poor contact with the added water, and may cause problems in downstream operations.

Therefore, there is a need in the industry for processing dehydrated and salty hydrocarbon feeds to effect desalting to obtain feeds suitable for downstream processing operations including upgrading.

SUMMARY OF THE INVENTION

In accordance with one aspect of the invention, there is provided a method of processing a dehydrated and salty hydrocarbon feed having a solid salt dispersed in a hydrocarbon material, the method comprising contacting the dehydrated and salty hydrocarbon feed with an active agent under a first operating condition, wherein under the first operating condition the active agent has an initial active agent solubility in the hydrocarbon material, and the salt has a salt solubility in the hydrocarbon material. Subsequently, modulating operating conditions to provide a second operating condition, wherein under the second operating condition, the active agent has a secondary active agent solubility in the hydrocarbon material that is less than the initial active agent solubility so as to form a separable active agent phase, wherein the salt solubility in the active agent is substantially greater than the salt solubility in the hydrocarbon material under both the first and second operating conditions such that the salt dissolves in the active agent. Finally, allowing the separable active agent phase to separate from the hydrocarbon material under the second operating condition.

In various aspects, modulating operating conditions to provide the second operating condition may comprise modulating temperature, pressure, time or a combination thereof. In various aspects, the active agent may comprise a protic active agent, and the protic active agent may comprise an alcohol selected from alcohols having 1 to 4 carbons, which may comprise a linear carbon chain. In various aspects, the alcohol may be methanol. In various aspects, the composition of the active agent may be modulated to achieve the initial active agent solubility in the hydrocarbon material, which may comprise adjusting a dielectric property of the active agent. In various aspects, the active agent may be a mixture that further comprises a modifier in a volume ratio of the active agent to the modifier such that the active agent remains substantially soluble in the hydrocarbon material under the first operating condition. In various aspects, the modifier may be water, another active agent, or other chemical compounds.

In various aspects, the salt dispersed in the hydrocarbon material may be at least about 0.0001 wt. % of the hydrocarbon material, and the separable active agent phase under the second operating condition may comprise a salt content ranging from about 1 part per million or more depending on the origin of the hydrocarbon material. For example, in some hydrocarbon materials, the salt content may range for about 1 part per million to thousands of parts per million (e.g., 10,000 ppm).

In various aspects, the separable active agent phase may be further recovered, and the separable active agent phase may be separated from the salt to obtain a recovered active agent, which may then be recycled to the contacting step for reuse in the process.

In another aspect, there is provided an apparatus for processing a dehydrated and salty hydrocarbon feed having a solid salt dispersed in a hydrocarbon material, the apparatus comprising a source of the dehydrated and salty hydrocarbon feed, a source of an active agent, contacting means for contacting the dehydrated and salty hydrocarbon feed with the active agent, modulating means for modulating operating conditions to provide a first operating condition and a second operating condition, wherein under the first operating condition the active agent has an initial active agent solubility in the hydrocarbon material, and the salt has a salt solubility in the hydrocarbon material, and wherein under the second operating condition the active agent has a secondary active agent solubility in the hydrocarbon material that is less than the initial active agent solubility so as to form a separable active agent phase. The salt solubility in the active agent is substantially greater than the salt solubility in the hydrocarbon material under both the first and second operating conditions such that the salt dissolves in the active agent. The apparatus may also comprise separating means for separating the separable active agent from the hydrocarbon material depleted in the salt under the second operating condition.

BRIEF DESCRIPTION OF THE DRAWINGS

In accompanying drawings which illustrate embodiments of the invention.

DETAILED DESCRIPTION

Figure 1:
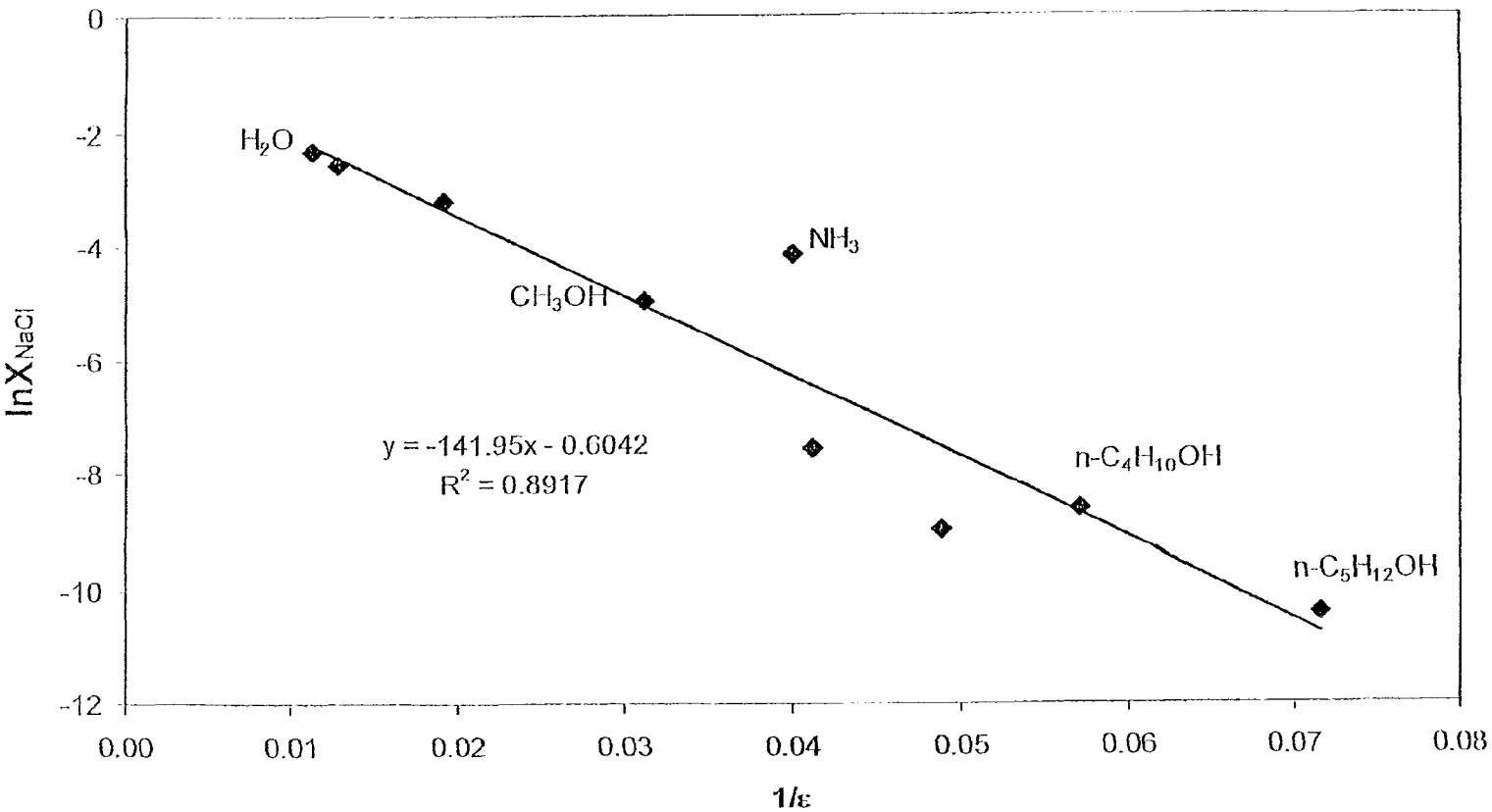
FIG. 1 illustrates a plot of log (mole fraction of NaCl) vs. reciprocal dielectric constant shown in Table 1.

Reference will now be made in detail to implementations and embodiments of various aspects and variations to the invention, examples of which are illustrated in the accompanying drawings.

In various embodiments, the term "a dehydrated and salty hydrocarbon feed" refers to any natural or synthetic liquid, semi-liquid or solid hydrocarbon material derived from oil sands processing in situ and ex situ including hydrocarbon material having an API value of less than about 10°, heavy (e.g., about 10 to 22.3° API), medium (e.g., about 22.3 to 31.1° API) and light (e.g., > about 31.1° API) oil production, off shore oil production, natural gas operations, conventional oil, secondary and tertiary recovery, or any other industry (e.g., biofuel industry) wherein the hydrocarbon material comprises at least one salt and substantially no aqueous component (e.g., water), or wherein the hydrocarbon material comprises at least one salt and has been processed or treated to have the aqueous component substantially removed leaving the salts substantially dry and dispersed in the hydrocarbon material.

Processing or treatment of the hydrocarbon feed that substantially removes the aqueous component and produces a dehydrated and salty hydrocarbon feed may include physical and chemical processing such as, for example, bulk and interstitial water removal using conventional technologies, separation or fractionation, thermal treatment or processing (e.g., flashing of water or other lighter hydrocarbon fraction and thermal cracking) or a combination thereof. In various embodiments, the dehydrated and salty hydrocarbon feed may comprise various levels of chemical contaminants in addition to salts such as, for example, various levels of hydrogen sulfide, organosulfur and inorganic sulfur compounds, organometallic and inorganic species, surfactants, solids, or processing additives.

In various embodiments, the dehydrated and salty hydrocarbon feed may have an initial viscosity ranging from less than about 1 cP to about 1,000,000 cP or greater. Suitable viscosities at various processing conditions may be determined by the rate of mass transfer required to achieve desalting at a given feed rate.

In various embodiments, the dehydrated and salty hydrocarbon feed may have a concentration of the aqueous component (e.g., water content) ranging from about 0 wt. % to about 0.50 wt. % or about 0 wt. % to about 0.05 wt. %, wherein the salt solubility in the aqueous component is exceeded such that the salt is precipitated in the hydrocarbon material. In these circumstances, the salt content in the hydrocarbon material versus the salt content present in the aqueous component being such that the solubility limit of the salt in the aqueous component is exceeded at the conditions under which the hydrocarbon feed is processed in the various embodiments.

In this specification, the terms "salt" and "salts" are used interchangeably, and unless the context dictates otherwise, indicate one or more organic or inorganic salts (e.g., normal, acidic or basic, simple, double, or complex) or salt-forming species, including salts that are typically found in bitumen, bitumen-derived hydrocarbon fractions or conventional oils and heavy oils. Predominant inorganic salts may be one or more chlorides (e.g. monovalent and divalent), sulphates, carbonates and bicarbonates. The predominant counterion for such inorganic salts may be sodium, although lesser amounts of magnesium, potassium and calcium may be present. An example of an organic salt or a salt forming species that may be present could be a naphthenate such as that formed from a reaction of naphthenic acid present in the hydrocarbon material. Such salts or salt-forming species in the dehydrated and salty hydrocarbon feed are generally dispersed in the hydrocarbon material as fine salt solids. In various embodiments, these fine salt solids may have a diameter of less than about half that of the size of the water droplets (e.g., less than about 10 to about 50 microns) originally present in the water-in-hydrocarbon emulsion prior to dehydration. The terms "dispersed salt content" or "dispersed salt" or "salt content" refer to, unless context dictates otherwise, salts that are substantially dispersed and suspended in the hydrocarbon material rather than being dissolved in water as typically occurs in water-in-hydrocarbon emulsions. In any of these instances, the salt exists as a solid in a separate and distinct phase from the hydrocarbon material. The dispersed salts in the hydrocarbon material may be in the form of solid salt crystals or particles substantially free of water (e.g., oil-wet salts), solid salts having an aqueous layer or aqueous film saturated with dissolved salt, or a mixture thereof.

The dehydrated and salty hydrocarbon feed to be treated to effect desalting according to various embodiments may comprise a content of one or more dispersed salts or salt-forming species ranging from about 0.1 parts per million to about 2 parts per million (ppm), about 2 ppm to about 50 ppm, about 50 ppm to about 100 ppm, about 100 ppm to about 200 ppm, about 200 ppm to about 300 ppm, about 300 ppm to about 400 ppm, about 400 ppm to about 500 ppm, about 500 ppm to about 750 ppm, about 750 ppm to about 900 ppm, or about 50,000 ppm or more. For example, in particular embodiments in which the dehydrated and salty hydrocarbon feed is dehydrated and salty dilbit, the dilbit may comprise as much as about 15,000 ppm of sodium chloride, about 350,000 ppm of calcium chloride, about 100,000 ppm of magnesium chloride, about 1,500 ppm of calcium carbonate, about 100 ppm of magnesium carbonate or a combination thereof. The salt content of the dehydrated and salty hydrocarbon feed will vary depending, for example, on the source and chemical composition of the feed, the amount of aqueous phase and concentrations of dissolved salts initially present prior to dehydration, subsequent treatment, or a combination thereof.

In this specification, the term "dehydrated and salty dilbit" refers to dehydrated and salty bitumen diluted with suitable hydrocarbon diluents such as naphtha, other lower density and viscosity liquid hydrocarbon-comprising mixtures such as diesel, kerosene or other oil fractions, or pure hydrocarbons such as propane, toluene and the like. The ratio of the dehydrated and salty bitumen to diluent may range from about 10:1 to about 1:1, or about 1:1 to about 1:10.

In this specification, the terms "active agent" and "active agent composition" are used interchangeably and refer to a chemical compound or a composition that, when contacted with the dehydrated and salty hydrocarbon feed, is able to effect, at selected processing parameters, desalting wherein:

i. the active agent has an initial active agent solubility in the hydrocarbon material of the dehydrated and salty hydrocarbon feed. The initial active agent solubility in the hydrocarbon material may range from a solubility value above water's solubility in the hydrocarbon material to a solubility value wherein the active agent is fully miscible with the hydrocarbon material. In various embodiments, the active agent solubility in the hydrocarbon material may range from about 0.01 wt. % to about 1 wt. %, or about 1 wt. % to about 10 wt. %, or about 10 wt. % to about 50 wt. % or greater;

ii. the salt has a salt solubility in the hydrocarbon material of the dehydrated and salty hydrocarbon feed. Preferably, the salt is substantially insoluble in the hydrocarbon material. In various embodiments, the salt solubility in the hydrocarbon material may range from about 0 wt. % to about 0.0001 wt. % (1 ppm). In the present invention, the salt has a dispersed salt content in the hydrocarbon material of the dehydrated and salty hydrocarbon feed. In various embodiments, the dispersed salt content in the hydrocarbon material may be about 0.0001 wt. % to about 0.001 wt. %, about 0.001 wt. % to about 0.1 wt. %, or about 0.1 wt. % to about 1 wt. or more. The upper limit of the dispersed salt content in the hydrocarbon material will depend on the origin and processing of the hydrocarbon feed; and iii. the salt has a salt solubility in the active agent, the salt solubility in the active agent being greater than the salt solubility in the hydrocarbon material such that the active agent may solubilize the salt and form a distinct salty active agent phase at selected conditions to effect desalting of the hydrocarbon material. In various embodiments, the salt solubility in the active agent may range from about 0.1 wt. % to about 10 wt. %, about 0.1 to about 25 wt. %, or about 0.1 to about 50 wt. %.

The solubility of a salt in various active agents may be estimated by using the relationship between dielectric constant of the active agent and mole fraction of salt in solution. This relationship is based on the consideration of the Born energies of the ions in the active agent as is shown in Formula 1, where $C_1$ and $C_2$ are constants, i is index for $i^{th}$ solvent, $\in$ is dielectric constant for $i^{th}$ solvent, and X is mole fraction $$\ln X_{NaCl}^{i} = \frac{C_1}{\varepsilon_i} + C_2 \qquad \text{(FORMULA 1)}$$

For example, if the dielectric constants and solubility for sodium chloride are known for a few active agents, then the solubility in other active agents of known dielectric constants may be approximated. Table 1 shows measured solubility data for sodium chloride in potential active agents of differing dielectric constants. In various embodiments, the selection of a suitable active agent depends on process conditions and solubility required.

TABLE 1

| Potential Active Agent | MW (g/mole) | Dielectric Constant | NaCl Solubility (wt. %) | Temperature (° C.) |
|---|---|---|---|---|
| Water (for comparison) | 18.02 | 78.85 | 26.43 | 25 |
| ammonia | 17.03 | 25 | 5.3 | 20 |
| methanol | 32.04 | 32.08 | 1.29 | 25 |
| ethanol | 46.07 | 24.3 | 0.065 | 25 |
| 1-propanol | 60.10 | 20.45 | 0.012 | 25 |
| 1-butanol | 74.12 | 17.51 | 0.014 | 25 |
| 1-pentanol | 88.15 | 13.99 | 0.002 | 25 |
| hydrazine | 32.05 | 52 | 7.35 | 20 |
| hydroxylamine | 33.03 | 77.6 | 12.81 | 17.5 |

Notes:
(1) Water is used in various embodiments as a modifier and not as an active agent.

FIG. 1 is a plot of the data in Table 1 according to the above relationship in Formula 1. From the fit with the above data, solubility of sodium chloride in some other potential solvents was deduced. Based on the above correlation, the solubility of sodium chloride in dilbit as the hydrocarbon feed having a dielectric constant in the range of 3 to 10 (Table 2) may be estimated. Based on published data of R. S. Chow et al., *The Canadian Journal of Chemical Engineering*, vol. 82, August 2004, the dielectric constant of Athabasca bitumen is about 3.7 at 30° C. Dilution of the bitumen with naphtha will tend to lower the dielectric as shown in the same reference. The estimated solubility of sodium chloride at 25° C. in dilbit having dielectric constant between 3 and 10 appears to be less than 0.04 ppm or 40 ppb as is shown in Table 2.

TABLE 2

| | NaCl Solubility | |
|---|---|---|
| Dielectric Constant of Dilbit | Mole fraction | Concentration (ppm) |
| 3 | 1.5E−21 | 2E−16 |
| 4 | 2.1E−16 | 2E−11 |
| 5 | 2.6E−13 | 3E−08 |
| 10 | 3.7E−07 | 0.04 |

In various embodiments, measures of the degrees of solubility of the active agent in the hydrocarbon material include dielectric property of the active agent (i.e., dielectric constant of the active agent). In general, the closer the dielectric constant of the active agent is to the dielectric constant of the hydrocarbon material, the higher the solubility of the active agent in the hydrocarbon material.

In various embodiments, the dielectric property of a suitable active agent may range in value between the dielectric property value of the hydrocarbon material and the dielectric constant of pure water at particular processing conditions. For example, the dielectric property value of the active agent may range between the dielectric constant of bitumen diluted in naphtha at 20° C. (i.e., a value of about 3) and dielectric constant of water at 20° C. (i.e., value of 80).

In various embodiments, the degree of solubility of the active agent in the hydrocarbon material of the dehydrated and salty hydrocarbon feed may be modulated by modulating the properties (e.g., composition) of the active agent, the operating parameters (e.g., temperature, pressure, time parameters) or a combination thereof prior to contacting the active agent with the dehydrated and salty hydrocarbon feed, and at any stage of the process. Various active agent modulating means may be used to modulate the properties of the active agent such as, for example, a chamber comprising an inlet and a valve for metered introduction of one or more active agents (e.g., recycled active agent, new agents) and modifiers to produce a suitable composition of the active agent for treating a particular dehydrated and salty hydrocarbon feed or a particular hydrocarbon material under particular operating conditions or stage of the process. Examples of suitable modifiers are water and other active agents (e.g., protic compounds) with dielectric constants between about 3 and about 80 at 20° C. Different modulating means may be used at different stages of the process.

In various embodiments, the active agent may be a liquid, gas or mixture of liquid and gas. For example, in selected embodiments, the active agent may be mixed with the dehydrated and salty hydrocarbon feed as a liquid or permeated though the dehydrated and salty hydrocarbon feed as a gas. In various embodiments, the phase of the active agent may be also modulated at various stages of the process. For example, initially the active agent may be introduced into the dehydrated and salty hydrocarbon feed as a gas, and by modulating operating conditions such as the temperature for example, the active agent may be caused to become a liquid in the dehydrated and salty hydrocarbon feed at a subsequent stage of the process.

In various embodiments, suitable active agents may comprise a protic active agent which may comprise one or more electronegative atoms (e.g., fluorine, oxygen, nitrogen or chlorine). In various embodiments, one or more dipolar aprotic compounds may be used if combined with the protic active agent to form an active agent composition having suitable solubility in the hydrocarbon material of the dehydrated and salty hydrocarbon feed. In various embodiments, the protic active agent may comprise an alcohol (primary, secondary, tertiary), combinations of various alcohols, or alcohol/water mixtures having varying ratios of alcohol to water wherein water is a modifier and has a lower concentration compared to the total concentration of the active agent. Examples of suitable protic active agents include methanol, ethanol, propanol, butanol, pentanol, glycerol and various glycols (e.g., ethylene glycol), a combination of various protic active agents, and a combination of various protic active agents with varying ratios of water as the modifier in order to tailor the chemical properties of the active agent to the properties of the particular dehydrated and salty hydrocarbon feed to be treated (e.g., to modulate degree of solubility of the active agent in the hydrocarbon material of the dehydrated and salty hydrocarbon feed) and the desired efficiency for desalting.

In various embodiments, alcohols suitable as active agents are alcohols having 1 to 6 carbon atoms. In various other embodiments, alcohols suitable as active agents are alcohols having 1 to 6 carbon atoms in a linear chain. In further various embodiments, alcohols suitable as active agents are alcohols having 1 to 4 carbon atoms. In various other embodiments, alcohols suitable as active agents are alcohols having 1 to 4 carbon atoms in a linear chain. In embodiments in which the active agent composition comprises alcohols having more than 6 carbon atoms, such compositions preferentially comprise sufficient amounts of alcohols having 1 to 6 carbon atoms such that the composition has a suitable solubility in the hydrocarbon material of the feed.

In embodiments in which a suitable active agent composition comprises a mixture of alcohols having 1 to 6 carbon atoms or 1 to 4 carbon atoms with alcohols having more than 6 carbon atoms, a staged diffusion of the components of the active agent composition may be effected to progressively change the dielectric properties of the hydrocarbon material of the dehydrated and salty hydrocarbon feed. For example, the more non-polar longer alcohols may diffuse into the hydrocarbon material of the dehydrated and salty hydrocarbon feed first and change the properties of the hydrocarbon material, including the properties of the hydrocarbon material contacting the salt, or the properties of the salt/hydrocarbon material interface as a result of which the shorter more polar alcohols may subsequently diffuse into the modified hydrocarbon material contacting the salt or the salt/hydrocarbon material interface to further change the dielectric property of the modified hydrocarbon material or the salt/hydrocarbon interface and allow the active agent to more effectively access and solubilize the salt. Thus, in various embodiments, a succession of active agents may diffuse into the hydrocarbon material or the salt/hydrocarbon material interface as properties of the hydrocarbon material or the salt/hydrocarbon material interface change.

The amount of the active agent required to treat the dehydrated and salty hydrocarbon feed will be at least the amount of the active agent required to effect desalting of the hydrocarbon material in the dehydrated and salty hydrocarbon feed such that a hydrocarbon material depleted in the salt may have a dispersed salt content (a "resultant dispersed salt content") that is less than the initial dispersed salt content that was present in the dehydrated and salty hydrocarbon feed that was used as feedstock for the process of the present invention. In various embodiments, the resultant dispersed salt content may be substantially less than the initial dispersed salt content. This allows for the hydrocarbon material depleted in the salt to be processed downstream (e.g. by an upgrader) to produce downstream products. For illustration purposes, the resultant dispersed salt content may fall in the range of about 0 wt. % to about 1 ppm. In other embodiments, the resultant dispersed salt content may be more than about 1 ppm depending on what the acceptable tolerance for contaminants in the hydrocarbon material is in various commercial applications. In various embodiments, the active agent composition comprising a mixture of the active agent and a modifier such as water may have a concentration of the active agent in the mixture ranging from about 99.9 wt. % to about 99 wt. %, about 99 wt. % to about 90 wt. %, about 90 wt. % to about 80 wt. %, about 80 wt. % to about 70 wt. %, about 70 wt. % to about 60 wt. %, or about 60 wt. % to about 50 wt. %.

In various embodiments, suitable ratios of the active agent to the dehydrated and salty hydrocarbon feed may be in the range of about 1: about 99, about 1: about 49, about 1: about 20, about 1: about 10, about 1: about 5, about 1: about 1, about 2: about 1, about 5: about 1, or higher. Suitable ratios, however, may be further modulated depending on the properties of the active agent relative to the properties of the dehydrated and salty hydrocarbon feed. In selected embodiments, economics of the process may be a factor in selecting a suitable ratio as higher ratios require larger process units and larger volumes of active agents to circulate.

A suitable amount of the active agent relative to the amount of salt present in the dehydrated and salty hydrocarbon feed is such that the effective weight percent of the salt in the active agent will be below the solubility limit of the salt in the active agent at the process conditions if all the salt in the dehydrated and salty hydrocarbon feed were to be extracted into the active agent phase. In various embodiments, the mass ratio of the active agent to salty and dehydrated hydrocarbon feed may be, depending on the salt solubility in the active agent, at least about 2 times to about 1000 times of the mass ratio of salt present in the dehydrated and salty hydrocarbon feed.

In various embodiments, the volume ratio of the components in the active agent composition comprising a mixture of an active agent with another active agent or with water is such that the sum of volume fraction ($V_i$) multiplied by dielectric constant ($\in_i$) for the active agent (where i=1 to n for active agent component 1, 2, 3, etc.) and water falls between the values of the dielectric constants of the hydrocarbon material ($\in_h$) and water ($\in_w$) at process conditions. This is expressed mathematically by Formula 2.

$$\varepsilon_h < \sum_i \varepsilon_i V_i < \varepsilon_w \qquad \text{(FORMULA 2)}$$

A second suitable mixture of the active agents, or the active agent and water, is such that the resulting dielectric constant of the mixture when compared to a first suitable mixture is within about plus or minus five units at the same process conditions.

Suitable active agents for use in various embodiments may be identified as those having one or more of the following properties: good solubility for salts (e.g., for NaCl) particularly at low active agent/dehydrated and salty hydrocarbon feed ratios; high density contrast with the dehydrated and salty hydrocarbon feed to facilitate rapid gravity separation; minimal stable emulsion formation tendency with the dehydrated and salty hydrocarbon feed to facilitate rapid separation from the treated hydrocarbon material depleted in the salt; relatively low mutual solubility with the dehydrated and salty hydrocarbon feed at selected operating conditions to facilitate high recovery of the active agent from the treated hydrocarbon material depleted in the salt; suitable viscosity for effective mixing and contacting with the dehydrated and salty hydrocarbon feed; comprise substantially no harmful hetero-atoms for benign downstream processing; have suitable dielectric constants (polarity) at selected operating conditions relative to the particular dehydrated and salty hydrocarbon feed to be processed at the selected operating conditions and stages of the process; and do not form undesirable by products with the species found in the dehydrated and salty hydrocarbon feed. Table 3 shows examples of active agents having certain dielectric constants, which may be suitable for treating dehydrated and salty hydrocarbon feeds to effect desalting.

TABLE 3

| Potential Active Agent | Dielectric Constant (1) | Relative Polarity |
|---|---|---|
| Water (for comparison) | 78.85 | Most polar |
| Glycerol | 42.5 | |
| Ethylene glycol | 37.7 | |
| Methanol | 32.63 | |
| Ethanol | 24.3 | |
| 1-propanol | 20.1 | |
| 1-butanol | 17.1 | |
| 1-pentanol | 13.9 | |
| Hydrocarbon feed (dilbit) (for comparison) | 3.7 | Least polar |

Notes:
(1) Approximate values at 25° C.
(2) Water is used in various embodiments as a modifier and not as an active agent.

In various embodiments, active agents exhibiting one or more of the above properties may be further modified with other active agents, or water, or other chemical compounds (e.g., demulsifiers), or a combination thereof to achieve chemical properties that will allow to obtain the desired levels or efficiencies of desalting of a particular dehydrated and salty hydrocarbon feed under particular operating conditions, stages of the process or a combination thereof.

In various embodiments, one or more active agents may be present in the input dehydrated and salty hydrocarbon feed, and which may subsequently combine with additional active agents added to the dehydrated and salty hydrocarbon feed or with the hydrocarbon material to achieve an active agent mixture with properties (e.g., dielectric constant) suitable for achieving desalting at the particular operating conditions or stages of the process.

In various embodiments, the treatment of the dehydrated and salty hydrocarbon feed or of the hydrocarbon material with the active agent may be performed in one or more stages, using process conditions tailored to the properties of the dehydrated and salty hydrocarbon feed or of the hydrocarbon material at each stage, to achieve progressive desalting, phase separation, or a combination thereof.

In various embodiments, the time parameter required to effect the dissolution of salt in the active agent and to form the separable active agent phase will be such that a desired equilibrium is met under particular operating conditions. In various embodiments, for example, the time parameter may range from less than about 1 minute to less than about 2 hours. In other embodiments the time parameter may range from about 1 minute to about 2 hours. In yet other embodiments, the time parameter may range from about 2 hours to about 2 days. In yet other embodiments, the time parameter may range from about 2 days to one or a plurality of weeks.

Figure 2:
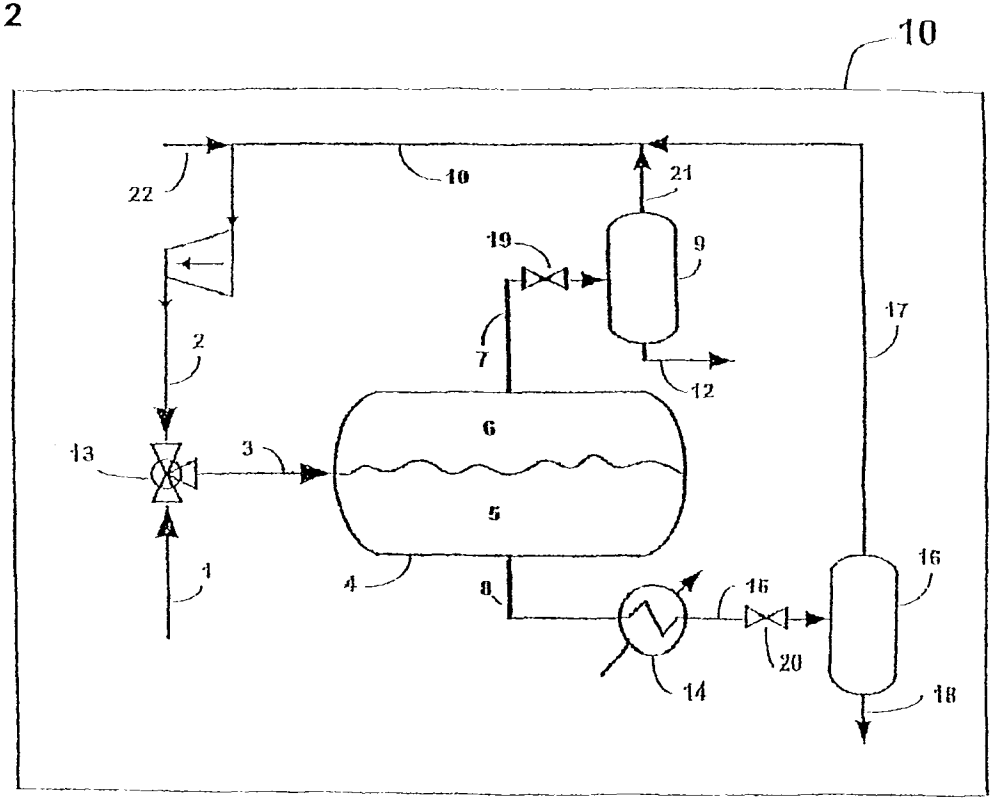
FIG. 2 illustrates a schematic diagram of system 10 according to a first embodiment of the invention.

Referring to FIG. 2, there is shown a first embodiment of a system 10 adapted for treating the dehydrated and salty hydrocarbon feed with the active agent to effect desalting of the feed. In the embodiment illustrated in FIG. 2, the dehydrated and salty hydrocarbon feed is introduced through line 1 and the active agent is introduced through line 2, in a counter-current or co-current manner, into a mixing valve or contactor 13 where turbulence is sufficient to produce a mixed feed having the active agent phase substantially dispersed, fully or partially dissolved, or a combination thereof in the hydrocarbon material to a desired degree. The active agent introduced into the contactor 13 has a flow rate that achieves sufficient dispersion, dissolution or a combination thereof of the active agent in the hydrocarbon material. In this embodiment, the active agent and the dehydrated and salty hydrocarbon feed may also have any suitable temperatures so long as the pressure is sufficiently high to maintain the active agent and the salty and dehydrated hydrocarbon feed in the liquid phase, or in a gaseous phase or a combination thereof in various other embodiments, and to maintain the desired degree of solubility of the active agent in the hydrocarbon material at the selected operating conditions. In various embodiments, mixing of the active agent with the dehydrated and salty hydrocarbon feed may also be effected using mixing means comprising static mixers, injectors, nozzles or tank mixers with impellers, turbines, propellers or paddles, or other high sheer mechanical devices with or without energy input (e.g. thermal energy). Any mixing means is suitable for use in the various embodiments (e.g., an inline device) as long as effective distribution, dissolution or both distribution and dissolution of the active agent within the feed may be achieved.

In the embodiment shown in FIG. 2, the mixed feed comprising the active agent is carried through line 3 into a separator 4, where conditions (temperature, pressure, time and hydrodynamics) are such that liquid-liquid phase separation occurs within a certain time to produce a used (salty) active agent phase 6 (also referred to as a separable active agent phase 6), and the treated hydrocarbon material 5 depleted in salt, the treated hydrocarbon material 5 being distinct from the used (salty) active agent phase 6 depending on the number of stages in the process. In selected embodiments, the used (salty) active agent phase 6 may either float on top of the treated hydrocarbon material 5 or vice versa depending on the choice of the active agent for a particular treatment. In various embodiments, active agent dissolved in the hydrocarbon material may also be separated from the hydrocarbon material at selected conditions. Table 4 shows densities of various active agents relative to the density of the hydrocarbon material (i.e., dilbit in this example).

TABLE 4

| Potential Active Agent | Dielectric Constant | NaCl Solubility (wt. %) (1) | ρ (g/mL) | Δρ (active agent-hydrocarbon feed) | |
|---|---|---|---|---|---|
| Water (for comparison) | 78.85 | 26.64 | 1.00 | 0.06 | ⇧ |
| Glycerol | 42.5 | 1.2 | 1.26 | 0.32 | |
| Ethylene glycol | 37.7 | 1.2 | 1.11 | 0.17 | Hydrocarbon feed floats |
| Methanol | 32.63 | 1.3 | 0.79 | -0.15 | |
| Ethanol | 24.3 | 0.065 | 0.79 | -0.15 | Hydrocarbon feed sinks |
| 1-propanol | 20.1 | 0.012 | 0.80 | -0.14 | |
| 1-butanol | 17.1 | 0.014 | 0.81 | -0.13 | |
| 1-pentanol | 13.9 | 0.002 | 0.82 | -0.12 | |
| Hydrocarbon feed (dilbit) (for comparison) | 3.7 | - | 0.94 | 0.00 | ⇩ |

Notes:
(1) Solubility in temperature range from about 20 to 25° C.
(2) Water is used in various embodiments as a modifier and not as an active agent.

In various other embodiments, the active agent and the dehydrated and salty hydrocarbon feed may also be contacted directly in the separator 4 for both mixing and subsequent separation. Examples of separators suitable for use in various embodiments of the present invention include conventional separators such as for example an inclined plate separator, a tank, or dynamic separators, including an inline device. Enhanced gravity separators such as centrifuges and hydrocyclones are also useful where space is limited or more intense dispersion of the active agent in the dehydrated and salty hydrocarbon feed is utilized.

In selected embodiments, staged mixing and separation may take place with the addition of one or more of the active agents at each stage to tailor the properties of the active agent to the changing properties of the hydrocarbon material to maximize desalting. Furthermore, operating conditions may be adjusted at each stage to maximize the efficiency of the active agent at each of the processing stages.

In the embodiment shown in FIG. 2, the used (salty) active agent phase 6 exits the separator 4 through line 7 and through a valve 19 into an active agent phase separator 9 for recovery where the used (salty) active agent phase 6 may be further processed in a conventional manner (e.g., distillation) to obtain a recovered active agent. As is shown in the embodiment in FIG. 2, in some embodiments, the salts may also be recovered through line 12 from the bottom of the active agent phase separator 9. The recovered active agent exits the active agent phase separator 9 through line 21 for further processing, reuse within the system 10, disposal or other uses. In the embodiments in which the recovered active agent is recycled into the system 10, make-up active agent, modifiers or both may be added to the system 10 through line 22 as is illustrated in FIG. 2 for example to modulate the properties of the recovered active agent, or alternatively the recovered active agent may be used to modulate the properties of the make-up active agent.

In various embodiments, the used (salty) active agent phase 6 may comprise a salt content in the range from about the limiting salt solubility in the active agent at stream conditions to about 0.0001 wt. % (about 1 ppm) depending on the ratio of active agent to dehydrated and salty hydrocarbon and the content of dispersed salts in the hydrocarbon material.

Figure 3:
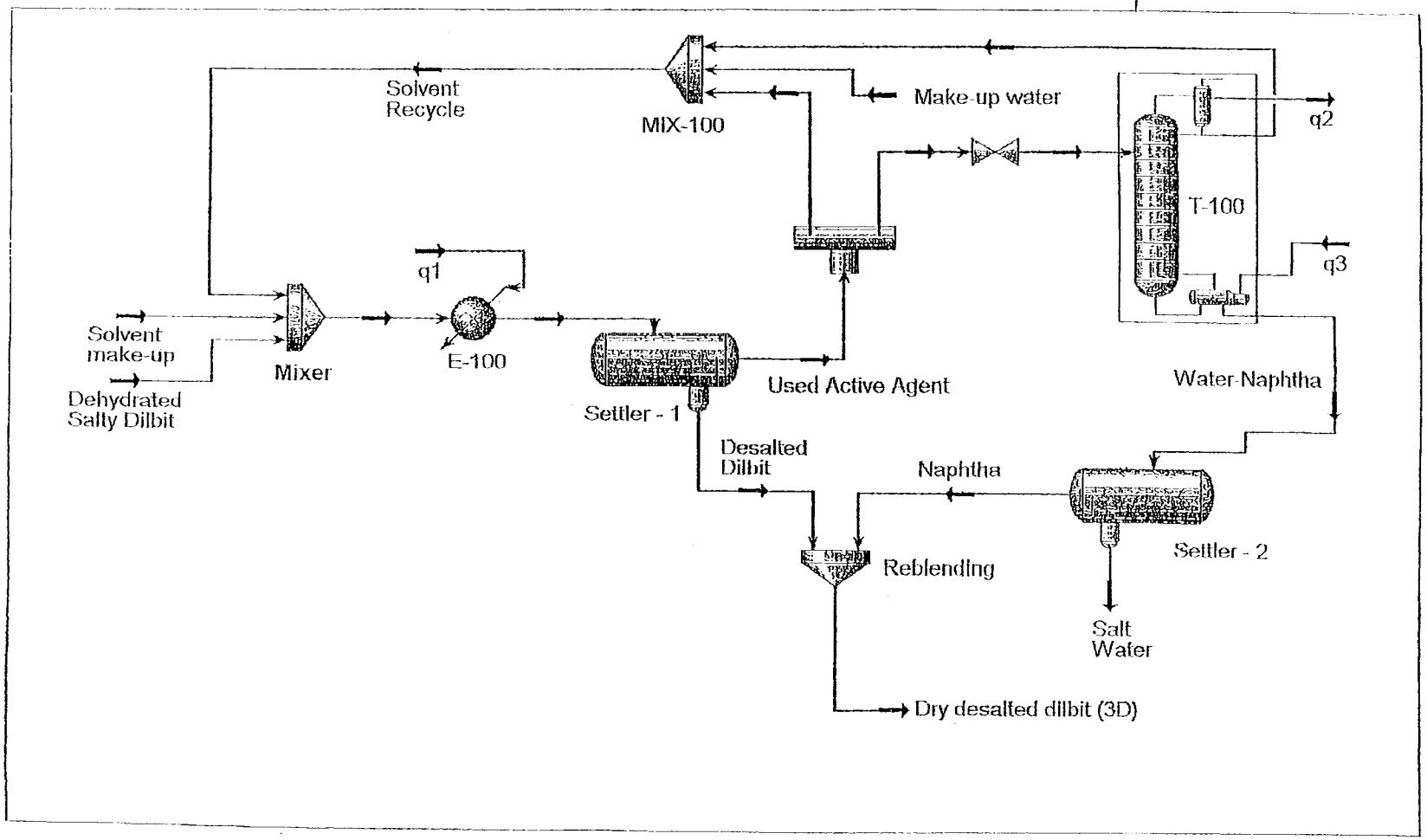
FIG. 3 illustrates a schematic diagram of system 10A according to another embodiment of the invention.
Figure 4:
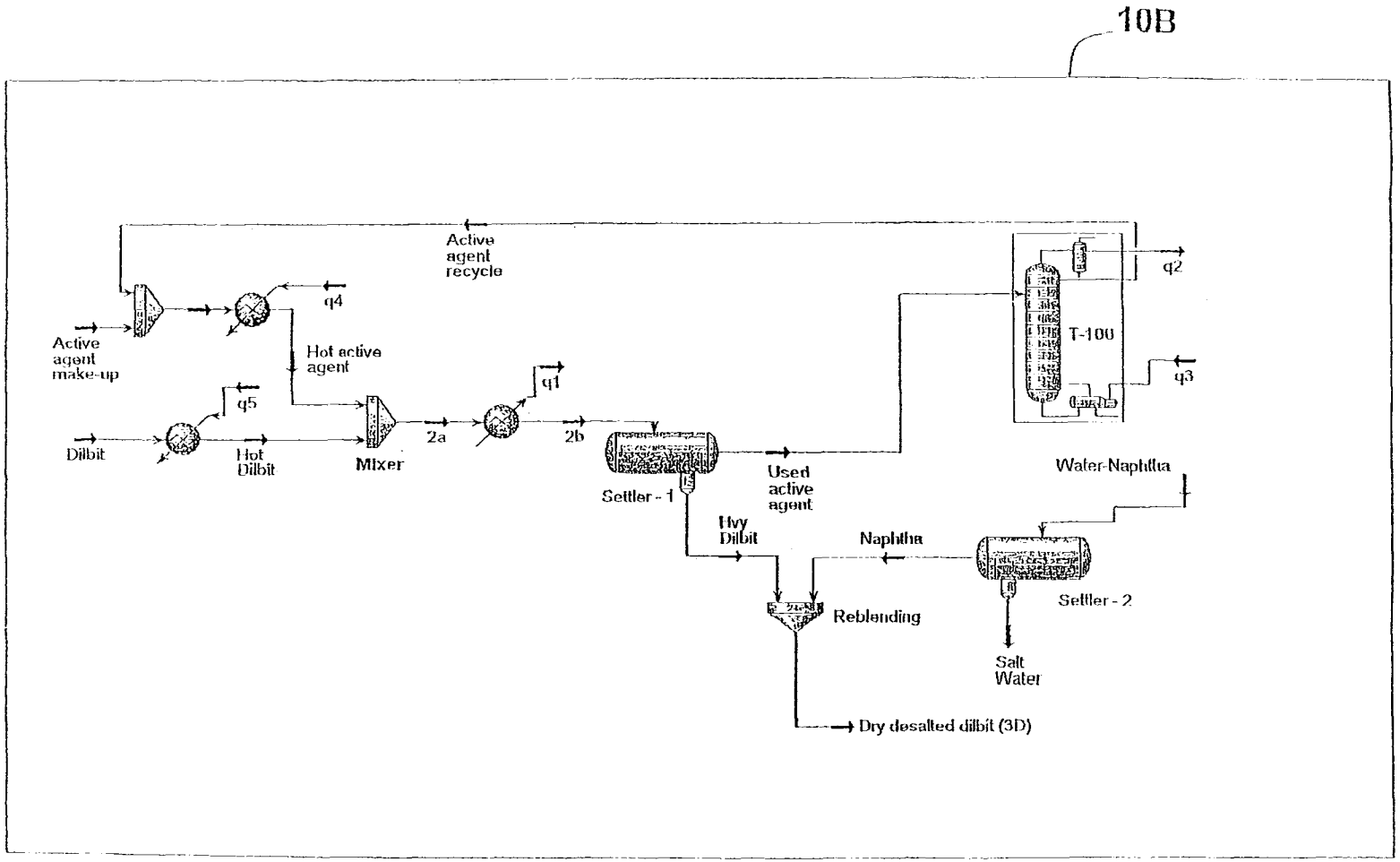
FIG. 4 illustrates a schematic diagram of system 10B according to another embodiment of the invention.

In the embodiment in FIG. 2, the hydrocarbon material 5 depleted in the salt is heavier than the used active agent phase 6, and exits the separator 4 through line 8. In selected embodiments, the hydrocarbon material 5 depleted in the salt may be warmed using a heat exchanger 14 for example. The hydrocarbon material 5 may be further sent to a hydrocarbon material separator vessel 16 for recovery of hydrocarbons through line 18 for example, in which any residual active agent may be stripped, for example, by heating. In various embodiments the hydrocarbon material 5 may comprise a dispersed salt content in the range of about 0 to about 10 ppm or less depending on the level of salt removal desired. FIG. 3 shows another embodiment (system 10A) with dehydrated and salty dilbit as an example of the dehydrated and salty hydrocarbon feed and a particular processing circuit design. In the embodiment shown in FIG. 3, only a portion of the used active agent is treated, for example to remove salts, while the remainder which is under-saturated with salts is recycled into the process. FIG. 4 (system 10B) shows another embodiment with dehydrated and salty dilbit as an example of the dehydrated and salty hydrocarbon feed and a particular processing circuit design where in hot dilbit and hot active agent are mixed (stream 2*a*) so that the active agent is substantially dissolved in the hydrocarbon material followed by another stage where the stream is cooled, so that the active agent is no longer soluble in the hydrocarbon material, prior to entering a separator.

Figure 5:
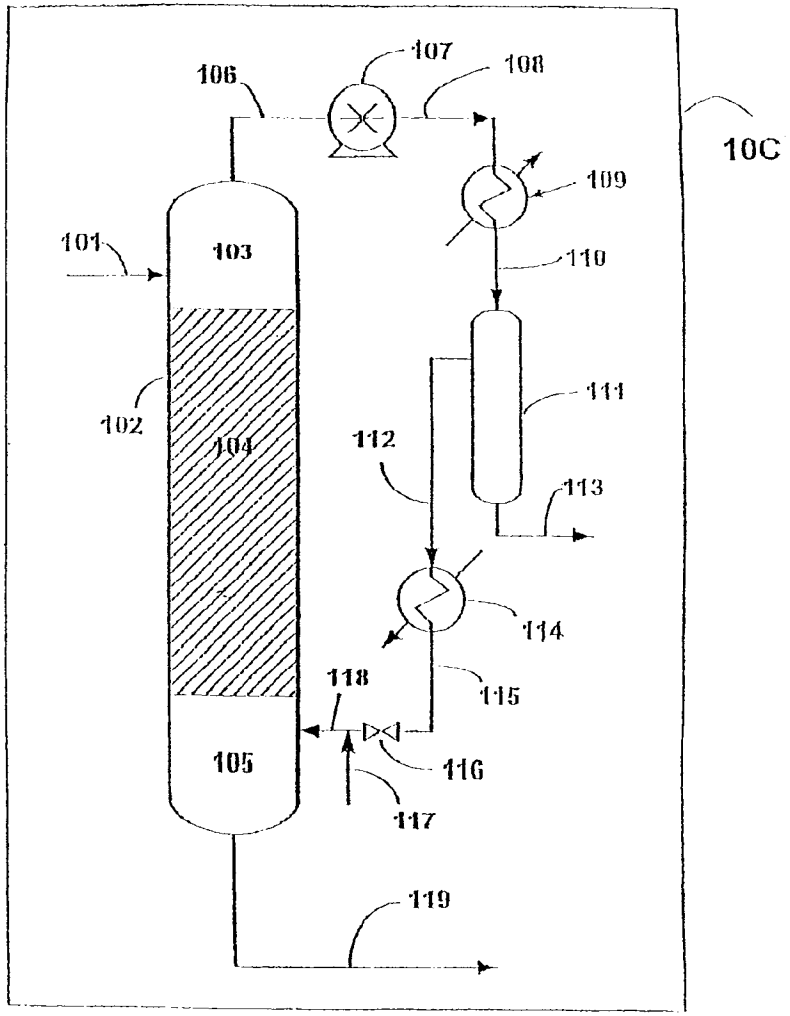
FIG. 5 illustrates a schematic diagram of system 10C according to another embodiment of the invention.

In yet another embodiment, as shown in FIG. 5 (system 10C), the dehydrated and salty hydrocarbon feed is introduced through line 101 into a counter-current liquid-liquid contactor 102. Contactor 102 may have an active agent disengagement zone 103 where the active agent is withdrawn above the point where the dehydrated and salty hydrocarbon feed is introduced, packing, trays or other types of column internals 104 to enhance contacting of the dehydrated and salty hydrocarbon feed with the active agent, and a disengaging zone 105 where the active agent is introduced above the disengagement zone such that the hydrocarbon material depleted in salts can be withdrawn following separation within a certain time. Suitable packing 104 may include unstructured or dumped packing (e.g., saddles and rings), structured or arranged packing (e.g., trays, cartridge and grids). The packing 104 may be chosen to further enhance desalting in addition to the action of the active agent and the influence of operational parameters. The active agent may enter the contactor 102 through line 118 while a make-up active agent may enter through line 117. Due to density differences between the active agent and the dehydrated and salty hydrocarbon feed, the more dense feed may flow down the contactor 102 and the less dense active agent may rise upward through the contactor 102 resulting in the active agent contacting the feed for treatment. In embodiments where the active agent is more dense than the dehydrated and salty hydrocarbon feed, the active agent may be introduced into zone 103, the feed may be introduced into zone 105, and the active agent recovery is reconfigured accordingly.

In another aspect, various configurations of the contactor 102 may be employed including (1) single or multiple stages of conventional mixer settler vessels, (2) pulsed columns, (3) mechanically agitated columns and (4) centrifugal extractors in a variety of operational modes (e.g., once-through mode or continuous recycle mode). In various embodiments, one or more contactors 102 may be used in various configurations to effect tailored processing including staged processing of various dehydrated and salty hydrocarbon feeds having various salt contents.

In the embodiment shown in FIG. 5, the active agent phase following separation (i.e., the used (salty) active agent phase or the separable active agent phase) exits the contactor 102 through line 106 which may be connected to a pump 107. The used (salty) active agent phase enters an active agent phase separator 111 in which the used active agent phase may be further processed. The recovered active agent exits the separator 111 through line 112 for further processing, recycling into the system 10C, disposal, or other use. The salt exits through line 113 to waste disposal or for other uses.

In various embodiments, effective dispersion and dissolution of the active agent in the dehydrated and salty feed hydrocarbon feed is desirable so that the active agent can penetrate the hydrocarbon material contacting the dispersed salt or the salt/hydrocarbon material interface to solubilize the salt. Through diffusion processes, the active agent, having a certain degree of solubility in the hydrocarbon material, migrates to the hydrocarbon material interface with the salt, initially wetting the surface of the salt, and thereby alters the interfacial tension between the salt and the hydrocarbon material, subsequently dissolving the salt thereby resulting in separation of the salty active agent phase from the hydrocarbon material to effect desalting.

In various embodiments, the method and apparatus of the present invention allow for utilizing low volumes of the active agent, which at selected stages of the process will be nearly totally dissolved in the dehydrated and salty hydrocarbon feed, which in selected embodiments may be a hot dehydrated and salty hydrocarbon feed. The dissolved active agent diffuses through the dehydrated and salty hydrocarbon feed and through the hydrocarbon layer contacting the salt solids to cause transfer of the solid salt into the active agent. The resultant treated hydrocarbon material depleted in salt may be subsequently cooled to reduce solubility and separate any unused active agent, still dissolved in the treated hydrocarbon material, and used active agent comprising the salt. In various embodiments, the method and apparatus of the present invention allow using small quantities of the active agent which are just enough to solubilize the salt from the dehydrated and salty hydrocarbon feed.

Although specific embodiments of the invention have been described and illustrated, such embodiments should not to be construed in a limiting sense. Various modifications of form, arrangement of components, steps, details and order of operations of the embodiments illustrated, as well as other embodiments of the invention, will be apparent to persons skilled in the art upon reference to this description. It is therefore contemplated that the appended claims will cover such modifications and embodiments as fall within the true scope of the invention. In the specification including the claims, numeric ranges are inclusive of the numbers defining the range. Citation of references herein shall not be construed as an admission that such references are prior art to the present invention.

What is claimed is:

1. A method of processing a dehydrated and salty oil sands-derived hydrocarbon feed having a solid salt dispersed in a hydrocarbon material, the method comprising:

a. contacting the dehydrated and salty oil sands-derived hydrocarbon feed with an active agent under a first operating condition, wherein under the first operating condition:
   i. the active agent has an initial active agent solubility in the hydrocarbon material; and
   ii. the salt has a salt solubility in the hydrocarbon material;

b. modulating operating conditions to provide a second operating condition, wherein under the second operating condition:
   i. the active agent has a secondary active agent solubility in the hydrocarbon material that is less than the initial active agent solubility so as to form a separable active agent phase,
   wherein the salt solubility in the active agent is substantially greater than the salt solubility in the hydrocarbon material under both the first and second operating conditions such that the salt dissolves in the active agent; and c. allowing the separable active agent phase to separate from the hydrocarbon material depleted in the salt under the second operating condition.

2. The method of claim 1 wherein the separable active agent phase is a distinct active agent phase.

3. The method of claim 1 wherein modulating operating conditions to provide the second operating condition comprises modulating temperature, pressure, time or a combination thereof.

4. The method of claim 1 wherein the active agent comprises a protic active agent.

5. The method of claim 4 wherein the protic active agent comprises an alcohol or a mixture of alcohols.

6. The method of claim 5 wherein the alcohol is an alcohol having 1 to 6 carbons.

7. The method of claim 6 wherein the alcohol having 1 to 6 carbons comprises a linear carbon chain.

8. The method of claim 6 wherein the alcohol is methanol.

9. The method of claim 4 wherein the active agent is a mixture that further comprises a modifier in a volume ratio of the active agent to the modifier such that the active agent remains substantially soluble in the hydrocarbon material under the first operating condition.

10. The method of claim 9 wherein the modifier comprises water.

11. The method of claim 9 wherein the modifier is water.

12. The method of claim 9 wherein the active agent is an alcohol having 1 to 4 carbons.

13. The method of claim 12 wherein the alcohol having 1 to 4 carbons is methanol.

14. The method of claim 1 wherein under the first operating condition the hydrocarbon material has an initial interfacial tension with the salt and a first interfacial tension with the active agent, and under the second operating condition the hydrocarbon material has a second interfacial tension with the active agent mixture comprising the salt, the second interfacial tension being higher than the first interfacial tension.

15. The method of claim 1 wherein the salt dispersed in the hydrocarbon material is at least about 0.0001 wt. % of the hydrocarbon material.

16. The method of claim 1 wherein the hydrocarbon material depleted in the salt comprises a salt content ranging from about 0 wt. % to about 10 parts per million.

17. The method of claim 1 wherein the separable active agent phase under the second operating condition comprises a salt content ranging from about 1 part per million or more.

18. The method of claim 1 further comprising recovering the separable active agent phase.

19. The method of claim 18 further comprising separating the separable active agent phase from the salt to obtain a recovered active agent.

20. The method of claim 19 further comprising recycling the recovered active agent to the contacting step.

21. The method of claim 20 wherein recycling comprises modulating a composition of the recovered active agent to achieve the initial active agent solubility in the hydrocarbon material.

22. The method of claim 21 wherein modulating comprises adjusting a dielectric property of the recovered active agent.

23. The method of claim 1 further comprising modulating a composition of the active agent to achieve the initial active agent solubility in the hydrocarbon material.

24. The method of claim 23 wherein modulating comprises adjusting a dielectric property of the active agent.

25. The method of claim 1 wherein the dehydrated and salty oil sands-derived hydrocarbon feed comprises a concentration of an aqueous component ranging from about 0 wt. % to about 0.05 wt. %, or from about 0.05 wt. % to about 0.5 wt. %.

26. The method of claim 1 wherein the solid salt ranges in content in the dehydrated and salty oil sands-derived hydrocarbon feed from about 0.0001 wt. % to about 0.001 wt. %, about 0.001 wt. % to about 0.1 wt. %, or about 0.1 wt. % to about 1 wt. or more.

27. The method of claim 1 wherein the active agent comprises a liquid, gas or a mixture thereof.

28. The method of claim 9 wherein the modifier has a lower concentration relative to a concentration of the active agent in the mixture.

29. The method of claim 28 wherein the active agent concentration in the mixture ranges from about 99.9 wt. % to about 99 wt. %, about 99 wt. % to about 90 wt. %, about 90 wt. % to about 80 wt. %, about 80 wt. % to about 70 wt. %, about 70 wt. % to about 60 wt. %, or about 60 wt. % to about 50 wt. %.

30. A method of processing a dehydrated and salty oil sands-derived hydrocarbon feed having a solid salt dispersed in a hydrocarbon material, the method comprising:

a. contacting the dehydrated and salty oil sands-derived hydrocarbon feed with an active agent comprising an alcohol under a first operating condition, wherein under the first operating condition:
   i. the active agent has an initial active agent solubility in the hydrocarbon material; and
   ii. the salt has a salt solubility in the hydrocarbon material;

b. modulating operating conditions to provide a second operating condition, wherein under the second operating condition:
   i. the active agent has a secondary active agent solubility in the hydrocarbon material that is less than the initial active agent solubility so as to form a separable active agent phase, wherein the salt solubility in the active agent is substantially greater than the salt solubility in the hydrocarbon material under both the first and second operating conditions such that the salt dissolves in the active agent; and c. allowing the separable active agent phase to separate from the hydrocarbon material depleted in the salt under the second operating condition.

31. The method of claim 30 wherein the separable active agent phase is a distinct active agent phase.

32. The method of claim 30 wherein modulating operating conditions to provide the second operating condition comprises modulating temperature, pressure, time or a combination thereof.

33. The method of claim 30 wherein the alcohol comprises a mixture of alcohols.

34. The method of claim 30 wherein the alcohol is an alcohol having 1 to 6 carbons.

35. The method of claim 34 wherein the alcohol having 1 to 6 carbons comprises a linear carbon chain.

36. The method of claim 34 wherein the alcohol is methanol.

37. The method of claim 30 wherein the active agent is a mixture that further comprises a modifier in a volume ratio of the active agent to the modifier such that the active agent remains substantially soluble in the hydrocarbon material under the first operating condition.

38. The method of claim 37 wherein the modifier comprises water.

39. The method of claim 37 wherein the modifier is water.

40. The method of claim 30 wherein the active agent is methanol.

41. The method of claim 30 wherein under the first operating condition the hydrocarbon material has an initial interfacial tension with the salt and a first interfacial tension with the active agent, and under the second operating condition the hydrocarbon material has a second interfacial tension with the active agent mixture comprising the salt, the second interfacial tension being higher than the first interfacial tension.

42. The method of claim 30 wherein the salt dispersed in the hydrocarbon material is at least about 0.0001 wt. % of the hydrocarbon material.

43. The method of claim 30 wherein the hydrocarbon material depleted in the salt comprises a salt content ranging from about 0 wt. % to about 10 parts per million.

44. The method of claim 30 wherein the separable active agent phase under the second operating condition comprises a salt content ranging from about 1 part per million or more.

45. The method of claim 30 further comprising recovering the separable active agent phase.

46. The method of claim 45 further comprising separating the separable active agent phase from the salt to obtain a recovered active agent.

47. The method of claim 46 further comprising recycling the recovered active agent to the contacting step.

48. The method of claim 47 wherein recycling comprises modulating a composition of the recovered active agent to achieve the initial active agent solubility in the hydrocarbon material.

49. The method of claim 48 wherein modulating comprises adjusting a dielectric property of the recovered active agent.

50. The method of claim 30 further comprising modulating a composition of the active agent to achieve the initial active agent solubility in the hydrocarbon material.

51. The method of claim 50 wherein modulating comprises adjusting a dielectric property of the active agent.

52. The method of claim 30 wherein the dehydrated and salty oil sands-derived hydrocarbon feed comprises a concentration of an aqueous component ranging from about 0 wt. % to about 0.05 wt. %, or from about 0.05 wt. % to about 0.5 wt. %.

53. The method of claim 30 wherein the solid salt ranges in content in the dehydrated and salty oil sands-derived hydrocarbon feed from about 0.0001 wt. % to about 0.001 wt. %, about 0.001 wt. % to about 0.1 wt. %, or about 0.1 wt. % to about 1 wt. or more.

54. The method of claim 30 wherein the active agent comprises a liquid, gas or a mixture thereof.

55. The method of claim 37 wherein the modifier has a lower concentration relative to a concentration of the active agent in the mixture.

56. The method of claim 55 wherein the active agent concentration in the mixture ranges from about 99.9 wt. % to about 99 wt. %, about 99 wt. % to about 90 wt. %, about 90 wt. % to about 80 wt. %, about 80 wt. % to about 70 wt. %, about 70 wt. % to about 60 wt. %, or about 60 wt. % to about 50 wt. %.

57. The method of claim 1 wherein the active agent is anhydrous.

58. The method of claim 30 wherein the active agent is anhydrous.

* * * * *